US012188336B2

(12) United States Patent
Smith et al.

(10) Patent No.: US 12,188,336 B2
(45) Date of Patent: Jan. 7, 2025

(54) SYSTEMS AND METHODS FOR WELLBORE LINER INSTALLATION UNDER MANAGED PRESSURE CONDITIONS

(71) Applicant: BP Corporation North America Inc., Houston, TX (US)

(72) Inventors: Jeffrey Smith, Cypress, TX (US); Sameh Morsy, Houston, TX (US); James Mckay, Houston, TX (US); Jeremy Brazan, Houston, TX (US); Andres Diaz, Katy, TX (US); Ahmed Shimi, Houston, TX (US); Wael Essam, Houston, TX (US); Christopher Scarborough, Katy, TX (US)

(73) Assignee: BP CORPORATION NORTH AMERICA INC., Houston, TX (US)

( * ) Notice: Subject to any disclaimer, the term of this patent is extended or adjusted under 35 U.S.C. 154(b) by 0 days.

(21) Appl. No.: 18/014,280

(22) PCT Filed: Aug. 5, 2021

(86) PCT No.: PCT/US2021/044814
§ 371 (c)(1),
(2) Date: Jan. 3, 2023

(87) PCT Pub. No.: WO2022/032012
PCT Pub. Date: Feb. 10, 2022

(65) Prior Publication Data

US 2023/0258057 A1 Aug. 17, 2023

Related U.S. Application Data

(60) Provisional application No. 63/062,848, filed on Aug. 7, 2020.

(51) Int. Cl.
*E21B 43/10* (2006.01)
*E21B 21/08* (2006.01)
*E21B 21/10* (2006.01)

(52) U.S. Cl.
CPC ..... *E21B 43/101* (2013.01); *E21B 21/08* (2013.01); *E21B 21/103* (2013.01); *E21B 43/10* (2013.01);
(Continued)

(58) Field of Classification Search
CPC ..... E21B 43/10; E21B 43/101; E21B 21/08; E21B 21/103; E21B 2200/04; E21B 2200/05
See application file for complete search history.

(56) References Cited

U.S. PATENT DOCUMENTS 6,491,103 B2 12/2002 Allamon et al.
7,434,625 B2 * 10/2008 Adams ..... E21B 34/142 166/373
(Continued)

FOREIGN PATENT DOCUMENTS

EP 3892816 A1 10/2021

OTHER PUBLICATIONS

PCT/US2021/044814 International Search Report and Written Opinion dated Nov. 9, 2021 (13 p.).

*Primary Examiner* — Brad Harcourt
(74) *Attorney, Agent, or Firm* — CONLEY ROSE, P.C.

(57) ABSTRACT

Casing installation assemblies for installing a casing within a borehole, as well as systems and methods related thereto are disclosed. In an embodiment, the casing installation assembly includes a tubular string, an isolation sub coupled to a downhole end of the tubular string, and a diverter sub coupled to and positioned downhole of the isolation sub. In addition, the casing installation assembly includes a landing
(Continued)

string coupled to the diverter sub and configured to be coupled to the casing. The isolation sub includes a valve assembly that is configured to selectively prevent fluid communication between the tubular string and the diverter sub.

13 Claims, 8 Drawing Sheets

(52) U.S. Cl.
CPC ..... *E21B 2200/04* (2020.05); *E21B 2200/05* (2020.05)

(56) References Cited

U.S. PATENT DOCUMENTS

| | | | |
|---|---|---|---|
| 10,214,999 | B2 | 2/2019 | Noske et al. |
| 2006/0011354 | A1 | 1/2006 | Logiudice et al. |
| 2011/0036588 | A1 | 2/2011 | Heironimus |
| 2015/0330186 | A1 | 11/2015 | Budde et al. |
| 2020/0232302 | A1 | 7/2020 | Budde et al. |

* cited by examiner

SYSTEMS AND METHODS FOR WELLBORE LINER INSTALLATION UNDER MANAGED PRESSURE CONDITIONS

CROSS-REFERENCE TO RELATED APPLICATIONS

This application is a 35 U.S.C. § 371 national stage application of PCT/US2021/044814 filed Aug. 5, 2021, and entitled "Systems and Methods for Wellbore Liner Installation Under Managed Pressure Conditions," which claims benefit of U.S. provisional patent application Ser. No. 63/062,848 filed Aug. 7, 2020, and entitled "Systems and Methods for Wellbore Liner Installation Under Managed Pressure Conditions," each of which is hereby incorporated herein by reference in its entirety for all purposes.

STATEMENT REGARDING FEDERALLY SPONSORED RESEARCH OR DEVELOPMENT

Not applicable.

BACKGROUND

A subterranean borehole for accessing underground hydrocarbon deposits (e.g., oil gas, etc.) may be formed by engaging a rotating drill bit with the earthen formation. As the borehole is extended, casing or liner pipe (which may generally be referred to herein as "casing") may be installed within the borehole so as to prevent collapse and to provide a central bore for inserting or withdrawing fluids or equipment from the borehole. As the subterranean borehole is drilled, a positive fluid pressure may be placed on the inner walls of the borehole so as to prevent the uncontrolled migration of formation fluids, such as, for instance, oil, gas, water, etc., into the borehole and thus up to the surface. Managed pressure drilling (MPD) systems may be utilized in some circumstances to more precisely maintain the desired positive pressure while avoiding over pressurizing the wellbore which may lead to formation fracturing, fluid loss, etc. Typically, an MPD system may utilize a pump and/or other mechanical system (e.g., a choke) to apply the desired pressure on the borehole, rather than relying on the pressure supplied by a fluid column within the borehole (e.g., such as a column of drilling mud or other injectable fluids).

BRIEF SUMMARY

Some embodiments disclosed herein are directed to a casing installation assembly for installing a casing within a borehole. In an embodiment, the casing installation assembly includes a tubular string, an isolation sub coupled to a downhole end of the tubular string, and a diverter sub coupled to and positioned downhole of the isolation sub. In addition, the casing installation assembly includes a landing string coupled to the diverter sub and configured to be coupled to the casing. The isolation sub comprises a valve assembly that is configured to selectively prevent fluid communication between the tubular string and the diverter sub.

Other embodiments disclosed herein are directed to a system for installing a casing within a borehole. In an embodiment, the system includes a wellhead assembly fluidly coupled to the borehole, a pump fluidly coupled to the borehole and configured to circulate a fluid within the borehole, and a casing installation assembly configured to be inserted through the wellhead assembly and into the borehole. The casing installation assembly includes a tubular string, an isolation sub coupled to a downhole end of the tubular string, and a diverter sub coupled to and positioned downhole of the isolation sub. In addition, the casing installation assembly includes a landing string coupled to the diverter sub and configured to be coupled to the casing. The isolation sub comprises a valve assembly that is configured to selectively prevent fluid communication between the tubular string and the diverter sub.

Still other embodiments disclosed herein are directed to a method of installing a casing within a borehole. In an embodiment, the method includes: (a) inserting a casing within the borehole with a casing installation assembly. The casing installation assembly includes a tubular string, an isolation sub coupled to a downhole end of the tubular string, and a diverter sub coupled to and downhole of the isolation sub. In addition, the method includes (b) applying a positive pressure to the borehole with a fluid circulated by a pump during (a). Further, the method includes (c) flowing the fluid through the casing and back into the borehole via the diverter sub during (a). Still further, the method includes (d) closing a valve assembly of the isolation sub and preventing the fluid from flowing into the tubular string during (a).

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
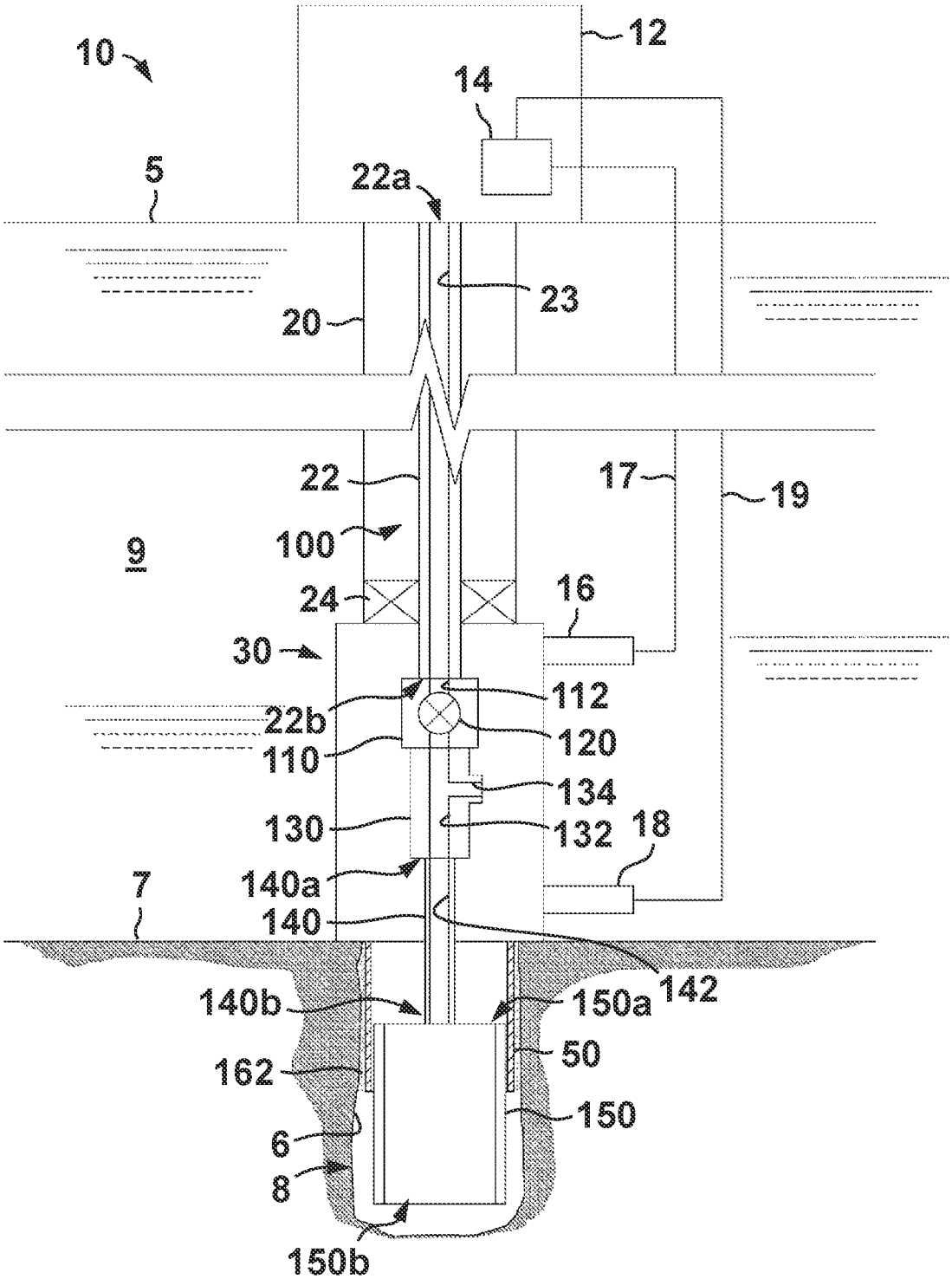
FIG. 1 is a schematic view of a system for installing a casing within a borehole according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%. Any reference to up or down in the description and the claims is made for purposes of clarity, with "up", "upper", "upwardly", "uphole", or "upstream" meaning toward the surface of the wellbore or borehole and with "down", "lower", "downwardly", "downhole", or "downstream" meaning toward the terminal end of the wellbore or borehole, regardless of the wellbore or borehole orientation.

As previously described, during operations to drill a subterranean borehole, positive pressure may be maintained on the borehole walls in order to prevent the uncontrolled inflow of formation fluids. When utilizing an MPD system (or other similar system) to apply the desired pressure within the borehole, operations to insert and secure casing within the borehole can be complicated given the competing needs to both seal off the borehole (e.g., to maintain the desired positive pressure), and to allow for a selectively open fluid flow path from the surface into the borehole for flowing cement and/or flowable valving devices (e.g., balls, darts, etc.).

Accordingly, embodiments disclosed herein include systems and methods for inserting and securing a casing within a subterranean borehole while utilizing a MPD system. In some embodiments, the systems and methods disclosed herein may provide a downhole isolation sub with a closable valve assembly therein for selectably preventing or allowing fluid communication between the borehole and the surface so as to facilitate both casing insertion and subsequent cementing operations.

Referring now to FIG. 1, a system 10 for installing a casing 150 within a borehole 8 is shown. In the embodiment of FIG. 1, system 10 is configured to insert a casing 150 within a borehole 8 that extends into the sea floor 7, and thus, the system 10 of FIG. 1 may be referred to as an "offshore" system. However, it should be appreciated that other embodiments may be configured to insert a casing (e.g., casing 150) within a land-based borehole (i.e., a borehole that extends into the earth from a location that is on dry land).

Generally speaking, system 10 includes a drilling rig 12 (or more simply, "rig 12") disposed at the sea surface 5, a wellhead assembly 30 disposed at the sea floor 7, and a riser 20 extending from the rig 12, through the subsea environment 9 to the wellhead assembly 30. Riser 20 includes an elongate tubular string that is configured to conduct fluids (e.g., either directly or via other tubular string coupled to or inserted within riser 20) between the rig 12 and the wellhead assembly 30. Wellhead assembly 30 generally comprises an interface for tools, strings, fluids for entering and exiting borehole 8. While not specifically shown, wellhead assembly 30 may comprise one or more blow out preventers configured to prevent the uncontrolled release of formation fluids from the borehole 8 (e.g., into the subsea environment 9). In addition, an outer casing 50 extends within borehole 8 generally from (or near) the sea floor 7. In some embodiments, the outer casing 50 may be secured within borehole 8 with cement 162. However, in other embodiments, no cement 162 is disposed between the borehole wall 6 and outer casing 50.

In addition, system 10 is also includes a MPD system for maintaining a desired pressure within the borehole 8 as previously described above. Specifically, system 10 includes a pump 14 disposed on the rig 12 that is configured to circulate fluid (e.g., drilling mud, water, oil, an emulsion, etc.) within the borehole 8 so as to maintain a desired positive pressure therein. The pump 14 is fluidly coupled to the borehole 8 via an inlet 18 and an outlet 16 and associated fluid lines 17, 19. In FIG. 1, the inlet 18 and outlet 16 are shown engaged with wellhead assembly 30; however, the precise location and arrangement of inlet 18 and outlet 16 may be varied in other embodiments.

A casing installation assembly 100 is inserted from the rig 12, through the riser 20 and wellhead assembly 30, and into borehole 8. As will be described in more detail below, the casing installation assembly 100 may be utilized to insert and install a casing 150 into the borehole 8 generally below the outer casing 50. Moving from rig 12 toward borehole 8, the casing installation assembly 100 includes a tubular string 22, an isolation sub 110, a diverter sub 130, a landing string 140, and casing 150.

Tubular string 22 is an elongate tubular member that extends from the rig 12, through the riser 20, and toward the borehole 8. Tubular string 22 includes a first or uphole end **22*a* disposed at the rig 12 and a second or downhole end 22*b* disposed within the wellhead assembly 30 or borehole 8. In addition, a central flow bore 23 extends through the tubular string 22 between the ends 22*a*, 22*b*. In some embodiments, tubular string 22 comprises a plurality of tubular members (e.g., pipes) that are coupled (e.g., threadably connected) end-to-end. As the tubular string 22 is inserted deeper within the riser 20 and borehole 8, additional tubular members are threadably connected to the uphole end 22*a*, thereby lengthening tubular string 22**.

An annular seal 24 is disposed about tubular string 22 at an upper end (or above entirely) the wellhead assembly 30. The annular seal 24 is configured to prevent the flow of fluid between the riser 20 and wellhead assembly 30 (and borehole 8) within the annular space surrounding the tubular string 22. Annular seal 24 may comprise any suitable packing or sealing assembly.

Isolation sub 110 is coupled (e.g., threaded) to the downhole end **22*b* of tubular string 22. Embodiments of isolation sub 110 are described in more detail below. However, generally speaking, isolation sub 110 includes a central flow bore 112 that is fluidly coupled to the flow bore 23 extending within tubular string 22. In addition, isolation sub 110** includes a valve assembly 120 that may selectively allow or prevent fluid communication through the central flow bore 112 during operations.

Diverter sub 130 is coupled to and positioned downhole of isolation sub 110. Diverter sub 130 includes a central flow bore 132 and a bypass flow path 134 coupled to and extending from central flow bore 132 to the environment surrounding the diverter sub 130 (which, in the depiction of FIG. 1, comprises the wellhead assembly 30 and borehole 8).

Landing string 140 is coupled between the diverter sub 130 and the casing 150. Landing string 140 includes a first or uphole end 140*a*, a second or downhole end 140*b* opposite uphole end 140*a* and a central flow bore 142 extending between the ends 140*a*, 140*b*. As was previously described for tubular string 22, landing string 140 may comprise a plurality of tubular members (e.g., pipes) coupled (e.g., threadably connected) end-to-end. Uphole end 140*a* is coupled to diverter sub 130, and downhole end 140*b* is coupled to casing 150.

Figure 2:
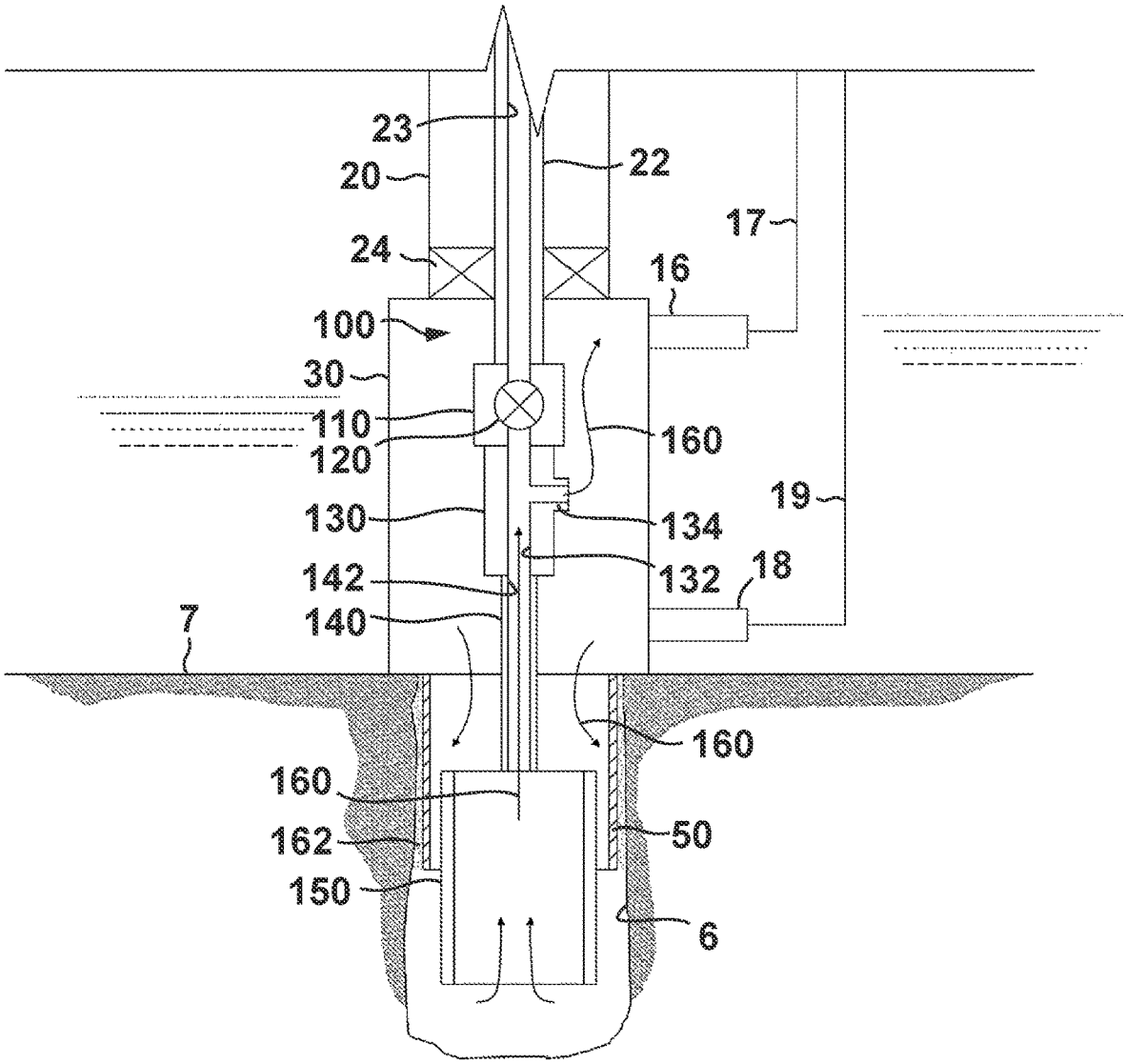
FIG. 2 is an enlarged view of the system of FIG. 1, showing a fluid circulation within the borehole during insertion of a casing according to some embodiments.

Referring now to FIGS. 1 and 2, during operations casing 150 is inserted, through outer casing 50 and into borehole 8 via tubular string 22, isolation sub 110, diverter sub 130, and landing string 140. During this process, pump 14 on rig 12 (FIG. 1) circulates fluid 160 (FIG. 2) through the borehole 8 at a relatively high pressure. For instance, in some embodiments, the pump 14 may circulate fluid 160 at 100 to 1200 pounds per square inch (psi) within borehole 8. As previously described above, the elevated pressures generated by fluid 160 may prevent formation fluids from flowing into the borehole 8 via borehole wall 6.

As casing 150 advances through outer casing 50 and into the borehole 8, fluid 160 may generally flow between the casing 150 and borehole wall 6 so as to allow the pressure of fluid 160 above and below the casing 150 to equalize. However, the casing 150 is sized so as to substantially fill the borehole 8 (e.g., so that casing 150 may act as a suitable support for borehole wall 6), and thus there is typically little space between the casing 150 and borehole wall 6. As a result, very slow insertion speeds for the casing 150 may be required to prevent increasing the pressure below the casing 150 above the fracture pressure of the subterranean formation. Alternatively, in this embodiment, casing installation assembly 100 may allow fluid 160 within borehole 8 to flow into casing 150, landing string 140, diverter sub 130, and out the bypass flow path 134 so as to more quickly equalize the pressure above and below the casing 150 and thereby increase the insertion speed of casing 150 during operations.

However, as the pressurized fluid 160 flows uphole through the casing 150, landing string 140 (e.g., via flow bore 142) and diverter sub 130, there is a risk that the fluid 160 may continue uphole through the isolation sub 110, and tubular string 22 to the rig 12. If the uphole end 22*a* of tubular string 22 is opened (e.g., so as to couple additional tubular members to uphole end 22*a* of as previously described), then the pressurized fluid 160 may be emitted from uphole end 22*a* such that pressure containment of borehole 8 may ultimately be lost and fluid (e.g., fluid 160) may be discharged from uphole end 22*a* at the rig 12 and/or onto the sea surface 5. Accordingly, during these casing insertion operations, the valve assembly 120 within isolation sub 110 may be actuated to a closed position so as to prevent the flow of fluid 160 into flow bore 23 of tubular string 22. Additional details of embodiments of valve assembly 120 are described in more detail below; however, for purposes of this general discussion, it should be appreciated that valve assembly 120 may be actuated to the closed position of FIG. 2 via pressure changes within flow bore 112, flowing a flowable valving device (e.g., ball, dart, etc.) through flow bore 23 to isolation sub 110, hydraulic pressure actuation, radio frequency identification (RFID) tags, electrical conductors (e.g., wires), and/or any other suitable actuation assembly and method.

Figure 3:
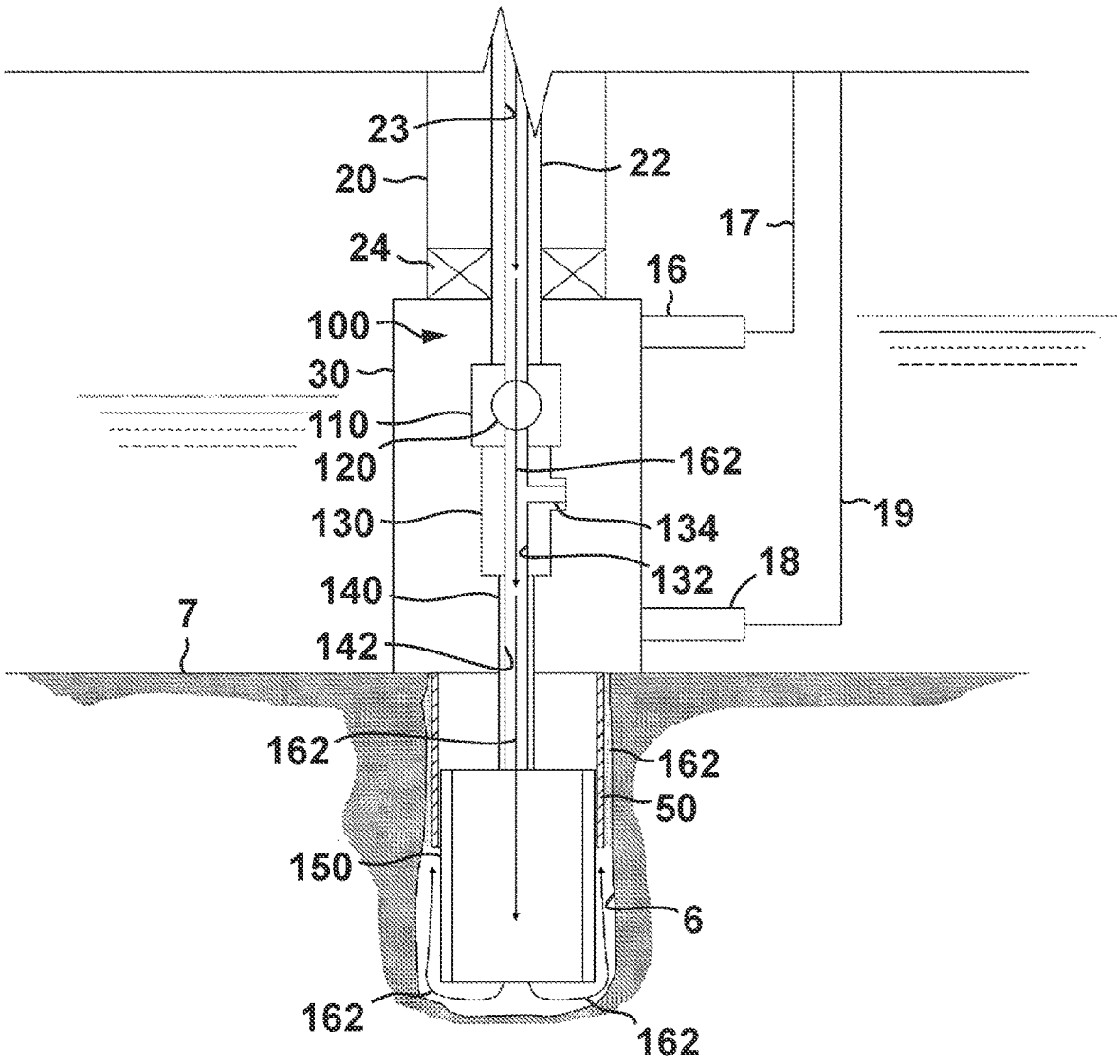
FIG. 3 is another enlarged view of the system of FIG. 1, showing cement flowing into the borehole according to some embodiments.

Referring now to FIGS. 1 and 3, once casing 150 is inserted within borehole 8 to the desired depth, casing 150 may be secured to the borehole wall 6 with cement 162. Specifically, in some embodiments cement 162 is pumped from the rig 12 at the sea surface 5 (FIG. 1), through flow bore 23 of tubing string 22. The valve assembly 120 is actuated to an open position so as to allow the cement 162 to flow through isolation sub 110, diverter sub 130, landing string 140, and finally into and through casing 150. Upon exiting the casing 150, the cement 162 then flows back upole and fills the annular space between casing 150 and borehole wall 6. During these cementing operations, flowable valving device (e.g., balls, darts, etc.) may be flowed into the well as part of the cementing job (e.g., ahead, within, or behind the cement slug to ensure that all injected cement is pushed or flowed into the annular spaced between borehole wall 6 and casing 150). In these circumstances, the open flow path defined through isolation sub 110 (e.g., through valve assembly 120) may be sufficient to allow passage of the cement 162 and flowable valve member(s) therethrough.

Thus, actuation of the valve assembly 120 of isolation sub 110 may facilitate pressure containment within the borehole 8 during insertion of casing 150, and may also allow for the injection of cement 162 (or other fluids) along with any flowable valving device (e.g., balls, darts, etc.) into the borehole during a subsequent cementing job following insertion of the casing 150. Additional details of various embodiments of isolation sub 110 and the valve assembly 120 are now described in more detail below.

Figure 4:
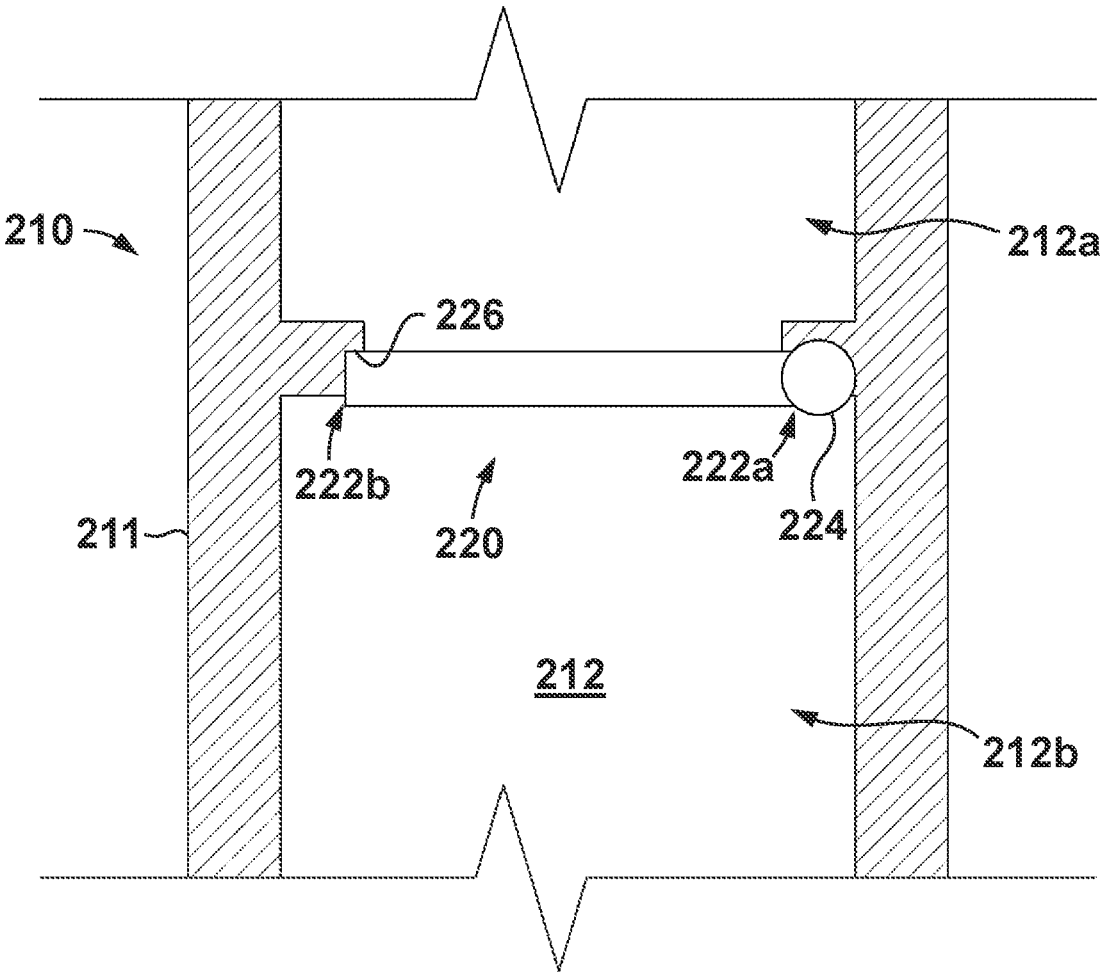
FIGS. 4 and 5 are side cross-sectional views of an isolation sub for use within the system of FIG. 1 according to some embodiments.
Figure 5:
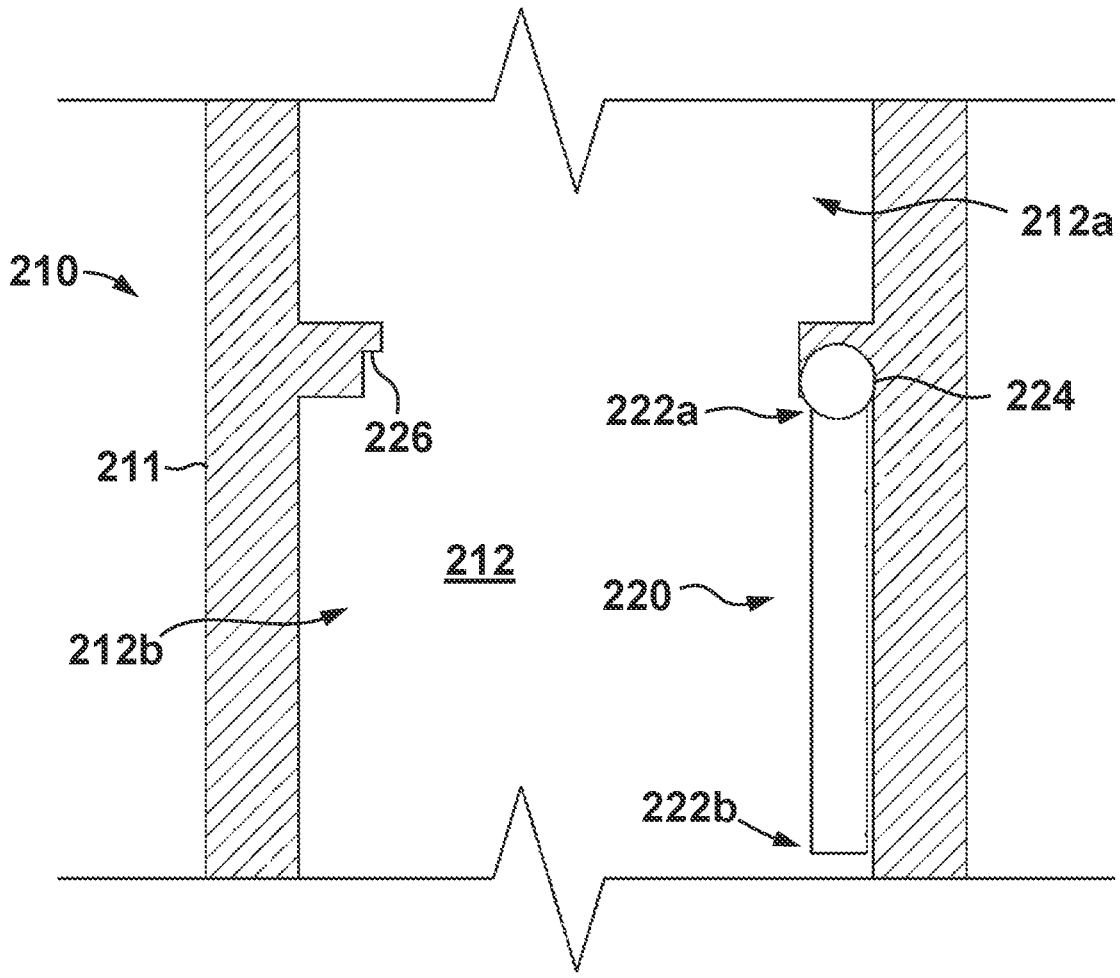

Referring now to FIGS. 4 and 5, an embodiment of an isolation sub 210 that may be used in the casing installation assembly 100 of FIGS. 1-3 as the isolation sub 110 is shown. Isolation sub 210 includes a body 211 that defines a flow bore 212. A valve assembly 220 is disposed within the inner flow bore 212 thereby separating flow bore 212 into a first or uphole portion 212*a* extending uphole of valve assembly 220 and a second or downhole portion 212*b* extending downhole of valve assembly 220.

Valve assembly 220 is a flapper valve that includes a valve member 222 rotatably coupled to body 211 via a hinge 225. Valve element 222 includes a first or proximal end 222*a* and a second or distal end 222*b* opposite proximal end 222*a*. Proximal end 222*a* is rotatably coupled to body 211 via a hinge 224. Accordingly, during operations, valve member 222 may rotate about hinge 224 within flow bore 212 between a first or closed position shown in FIG. 4 and a second or open position shown in FIG. 5.

When valve member 222 is in the closed position (FIG. 4), valve member 222 may sealingly engage with a seat 226 defined within body 211 to therefore close valve assembly 220 and prevent (or at least restrict) fluid communication between the uphole portion 212*a* and downhole portion 212*b* of flow bore 212. While not specifically shown, the seat 226 may extend annularly (e.g., circumferentially) about the entire circumference of body 211 so that the engagement between valve member 222 and seat 226 may also extend about the entire circumference of body 211 (and not just at the distal end 222*a* as depicted in the cross-sectional view of FIG. 4). Conversely, when valve member 222 is in the open position (FIG. 5), valve member 222 may be rotated about hinge 224 so as to project distal end 222*b* generally away from seat 226, to therefore open valve assembly 220 and allow fluid communication between the uphole portion 212*a* and downhole portion 212*b* of flow bore 212.

In some embodiments, valve member 222 may be actuated between the closed position (FIG. 4) and open position (FIG. 5) by differential between the uphole portion 212*a* and downhole portion 212*b* of flow bore 212. For instance, referring briefly to FIGS. 2 and 4, isolation sub 210 (FIG. 4) may be installed within casing installation assembly 100 in place of isolation sub 110. During operations, as casing 150 is inserted within borehole 8, the pressurized fluid 160 may be communicated to flow bore 212 via casing 150, landing string 140, and diverter sub 130 as previously described. As a result, the pressure within the downhole portion 212*b* of the flow bore 212 may be greater than the pressure within uphole portion 212*a*. The shape and arrangement of valve member 222 is configured so that this differential pressure may drive valve member 222 to rotate about hinge 224 and ultimately engage with seat 226, therefore preventing fluid flow from downhole portion 212*b* into uphole portion 212*a* as previously described.

Conversely, referring briefly now to FIGS. 2 and 5, when cement 162 is injected into the borehole 8 via tubing string 22, the pressure within uphole portion 212*a* may be greater than the pressure within downhole portion 212*b* within flow bore 212, so that the valve member 222 may be forced to rotate away from seat 226 toward the open position of FIG. 5. As a result, fluid communication between the uphole portion 212*a* and downhole portion 212*b* of flow bore 212 is allowed such that cement 162 and/or flowable valving devices may advance from tubular string 22 into casing 150 as previously described above.

Figure 6:
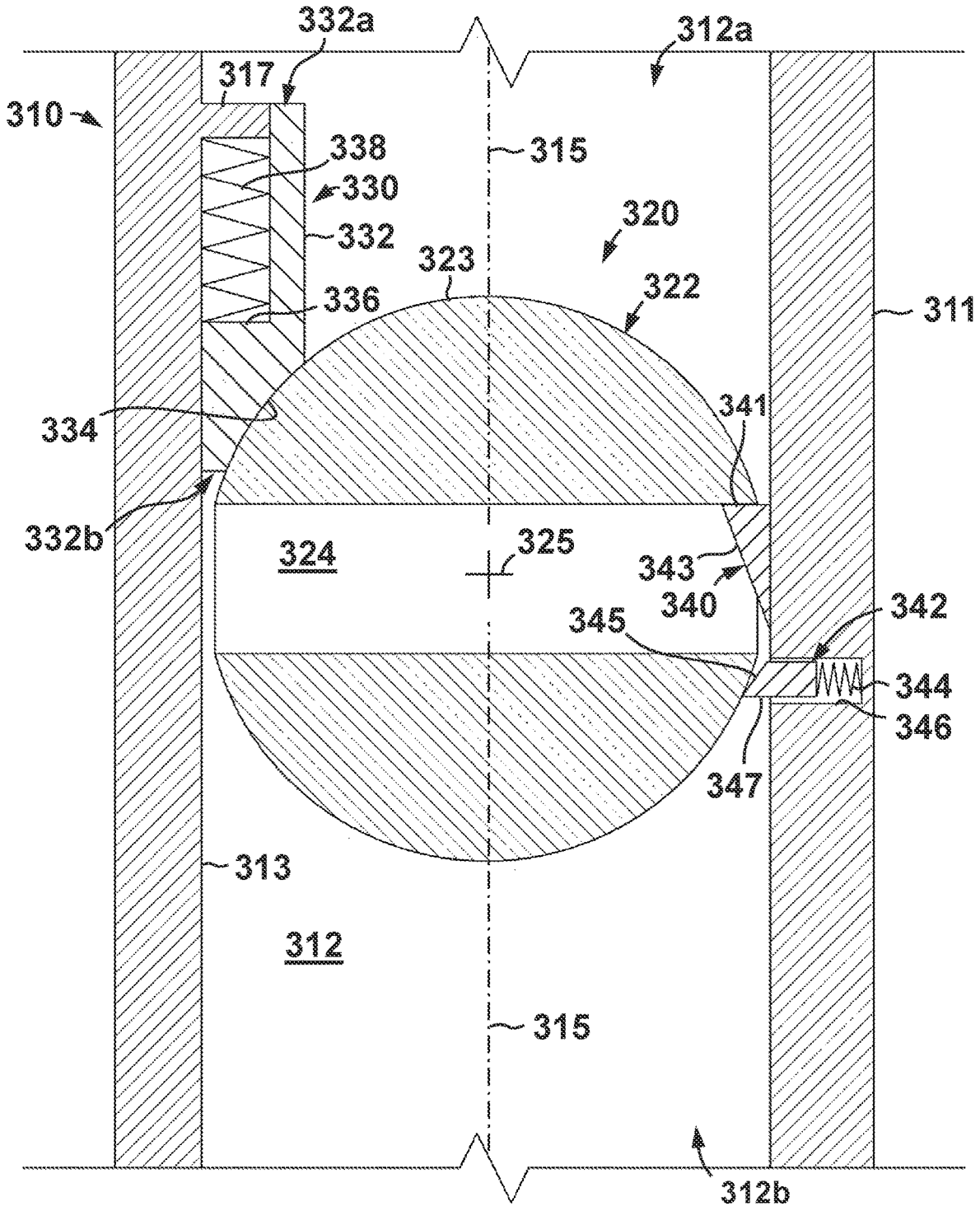
FIGS. 6 and 7 are side cross-sectional views of another isolation sub for use within the system of FIG. 1 according to some embodiments.

Referring now to FIG. 6, an embodiment of an isolation sub 310 that may be used in the casing installation assembly 100 of FIGS. 1-3 as the isolation sub 110 is shown. Isolation sub 310 includes a body 311 that defines a flow bore 312 extending along a central or longitudinal axis 315. A valve assembly 320 is disposed within the flow bore 312 thereby separating flow bore 312 into a first or uphole portion 312*a* extending uphole of valve assembly 320 and a second or downhole portion 312*b* extending downhole of valve assembly 320. Valve assembly 320 is a ball valve assembly that includes a spherical valve member 322 rotatably disposed within flow bore 312.

Spherical valve member 322 includes a spherical outer surface 323, and a throughbore 324. In some embodiments, the throughbore 324 extends through a center of spherical valve member 322. As will be described in more detail below, during operations, spherical valve member 322 may rotate about an axis 325 of the spherical valve member 322 that extends in a general perpendicular direction relative to axis 315 (e.g., the axis 325 may extend along a radius or radial direction of axis 315).

An actuation assembly 330 for transitioning spherical valve member 322 between an open and closed position is also disposed within flow bore 312, particularly within uphole portion 312*a*. Actuation assembly 330 includes a plunger 332 having a first or upper end 332*a* and a second or lower end 332*b* opposite upper end 332*a*. Lower end 332*b* includes a hemispherical surface 334. In addition, plunger 332 includes a shoulder 336 that is positioned between the ends 332*a*, 332*b*. Hemispherical surface 334 is engaged with spherical outer surface 323 of spherical valve member 322.

Actuation assembly 330 also includes a biasing member 338 extending axially between shoulder 336 of plunger 332 and a radially inwardly extending projection 317 along inner wall 313 of flow bore 312. In some embodiments, biasing member 338 comprises a coiled spring; however, any suitable biasing member may be utilized in other embodiments. Biasing member 338 is secured to projection 317 and shoulder 336 such that biasing member 338 is configured to bias plunger 332 uphole and toward projection 317 during operations.

In some embodiments, plunger 332 (or at least hemispherical surface 334) may extend annularly (e.g., circumferentially) about axis 315 so as to engage spherical valve member 322 along at least 90°, 180°, 270°, etc. of the circumference thereof (e.g., plunger 332 may be configured as a sleeve within flow bore 312). Similarly, in some embodiments, biasing member 338 may extend helically about axis 315 within flow bore 312. Thus, the specific arrangement of actuation assembly 330 in FIG. 6 is merely illustrative of some potential embodiments, and should not be interpreted as limiting other potential arrangements thereof in other embodiments.

Actuation assembly also includes a cam 340 that extend radially toward axis 315 from inner wall 313 of flow bore 312. Generally speaking, cam 340 is a wedge that includes an upper planar surface 341 and an inclined or ramped surface 343 extending from upper planar surface 341 to inner wall 314 of flow bore 312. Upper planar surface 341 may extend generally radially from inner wall 313 with respect to axis 315. In addition, ramped surface 343 generally faces downhole within flow bore 312 so that ramped surface 343 tappers toward inner wall 313 of flow bore 312 when moving axially (with respect to axis 315) along ramped surface 343 in a downhole direction. As best shown in FIG. 6, spherical valve member 322 may be initially disposed within flow bore 312 such that cam 340 extends into throughbore 324.

Also, a locking pin 342 is disposed within a recess 346 extending into inner wall 313 of flow bore 312. A biasing member 344 is disposed within recess 346 and is configured to bias locking pin 342 radially inward toward axis 315 during operations. Locking pin 342 includes an inclined or ramped surface 345 and a lower planar surface 347. Ramped surface 345 generally faces uphole such that ramped surface 345 generally tapers toward inner wall 313 of flow bore 312 when moving axially along ramped surface 345 in an uphole direction. In addition, lower planar surface 347 extends generally radially with respect to axis 315.

Figure 7:
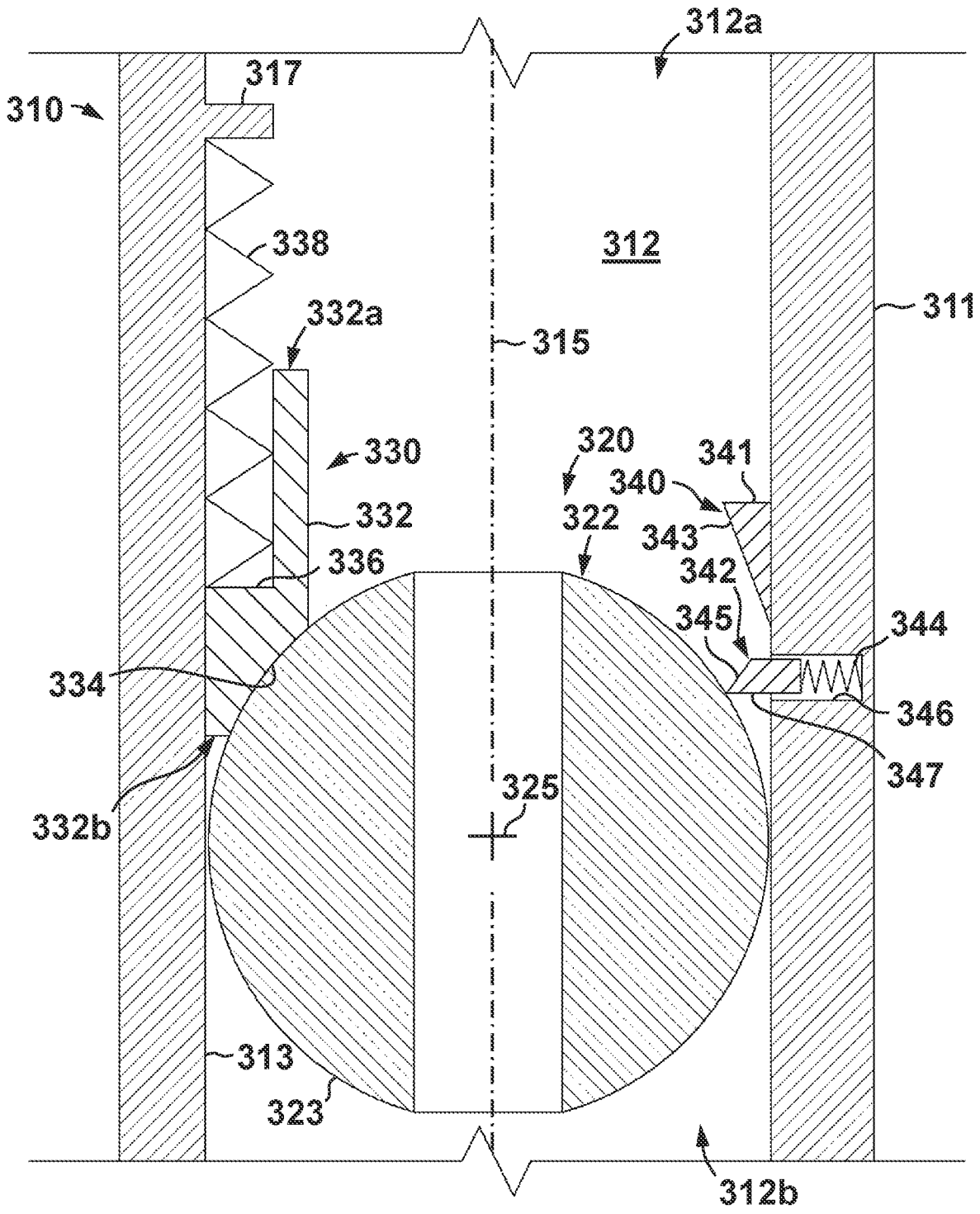

Referring now to FIGS. 6 and 7, during operations, spherical valve member 322 may be translated along axis 315 and simultaneously rotated about axis 325 via actuation assembly 330 so as to selectively establish fluid communication between uphole portion 312*a* and downhole portion 312*b* of flow bore 312. In particular, spherical valve member 322 may be transitioned between a first or closed position shown in FIG. 6 and a second or open position shown in FIG. 7.

When spherical valve member 322 is in the closed position (FIG. 6), throughbore 324 may extend generally radially relative to axis 315 and fluid communication between the uphole portion 312*a* of flow bore 312 and downhole portion 312*b* of flow bore 312 is prevented. Specifically, while not specifically shown, when spherical valve member 322 is in the closed position (FIG. 6), spherical outer surface 323 (or at least a portion thereof) may sealingly engage with inner wall 313 of flow bore 312 (or a valve seat defined or coupled thereto). Such sealing engagement and/or valve seats are not specifically depicted in FIG. 6 so as to simplify the drawing. In addition, when spherical valve member 322 is in the closed position (FIG. 6), the cam 340 is inserted into throughbore 324 such that upper planar surface 341 is engaged with or opposes the inner wall of throughbore 324. Further, in some embodiments (e.g., such as in the embodiment of FIG. 6), when spherical valve member 322 is in the closed position of FIG. 6, the spherical outer surface 323 is engaged with ramped surface 345 of locking pin 342 so that locking pin 342 is shifted radially away from axis 315 and into recess 346 against the bias provided by biasing member 344.

When it is desired to establish fluid communication between the uphole portion 312*a* and downhole portion 312*b* of flow bore 312, spherical valve member 322 may be transitioned from the closed position (FIG. 6) to the open position (FIG. 7). In particular, a pressure of the uphole portion 312*a* may be increased relative to the downhole portion 312*b*. This increased pressure within uphole portion 312*a* is applied to upper end 332*a* of plunger 332 so that plunger 332 is shifted axially (with respect to axis 315) downhole within flow bore 312 against the bias exerted by biasing member 338. As the plunger 332 shifts or translates axially downhole along axis 315, the spherical valve member 322 is also shifted axially downhole due to the engagement between hemispherical surface 334 of plunger 332 and spherical outer surface 323 of spherical valve member 322. However, due to the engagement between the cam 340 (particularly upper planar surface 341) and the inner wall of throughbore 324, as spherical valve member 322 is shifted axially downhole via plunger 332, spherical valve member 322 also, simultaneously rotates about axis 325. This downward translation and rotation of spherical valve member 322 continues until spherical valve member 322 achieves the open position of FIG. 7, wherein the throughbore 324 is generally aligned with axis 315 such that the uphole portion 312*a* and downhole portion 312*b* of flow bore 312 are placed in fluid communication via throughbore 324. In addition, once spherical valve member 322 is in the open position of FIG. 7, spherical outer surface 323 may disengage ramped surface 345 of locking pin 342 so that locking pin 342 may shift radially inward toward axis 315 and away from inner wall 313 via the bias provided by biasing member 344. As a result, spherical valve member 322 may be prevented from shifting uphole once the open position of FIG. 7 is achieved due to engagement between spherical outer surface 323 and lower planar surface 347 of locking pin 342

When isolation sub 310 is included within casing installation assembly 100 (e.g., in place of isolation sub 110), the relative pressure above and below the valve assembly 320 may be adjusted so as to actuate the spherical valve member 322 member between the open position (FIG. 6) and closed position (FIG. 7) so as to selectively place the landing string 144 and tubular string 122 in fluid communication with one another. In particular, referring briefly to FIGS. 2 and 6, in these embodiments as casing 150 is inserted within borehole 8, the pressurized fluid 160 may be communicated to flow bore 312 via casing 150, landing string 140, and diverter sub 130 as previously described. Initially, the spherical valve member 322 may be placed in the closed position of FIG. 6. As a result, the pressure within the downhole portion 312*b* of the flow bore 312 may be greater than the pressure within uphole portion 312*a* so as to prevent a downhole shift of spherical valve member 322 and therefore maintain spherical valve member 322 in the closed position (FIG. 6). As a result, fluid communication between the uphole portion 312*a* and downhole portion 312*b* of flow bore 312 is prevented and the heightened pressure within downhole portion 312*b* is not communicated into uphole portion 312*a* and tubular string 122.

Conversely, referring briefly now to FIGS. 2 and 7, when cement is injected into the borehole 8 via tubing string 22, the pressure within uphole portion 312*a* may be greater than the pressure within downhole portion 312*b* within flow bore 312, so that the spherical valve member 322 may be translated axially downward along axis 315 and simultaneously rotated about axis 325 toward the open position of FIG. 7 via the plunger 332 and cam 340 as previously described above. As a result, once spherical valve member 322 has been placed in the open position (FIG. 7), fluid (e.g., cement) is may be allowed to flow through the flow bore 312 between the uphole portion 312*a* and downhole portion 312*b* via throughbore 324 as previously described above.

Figure 8:
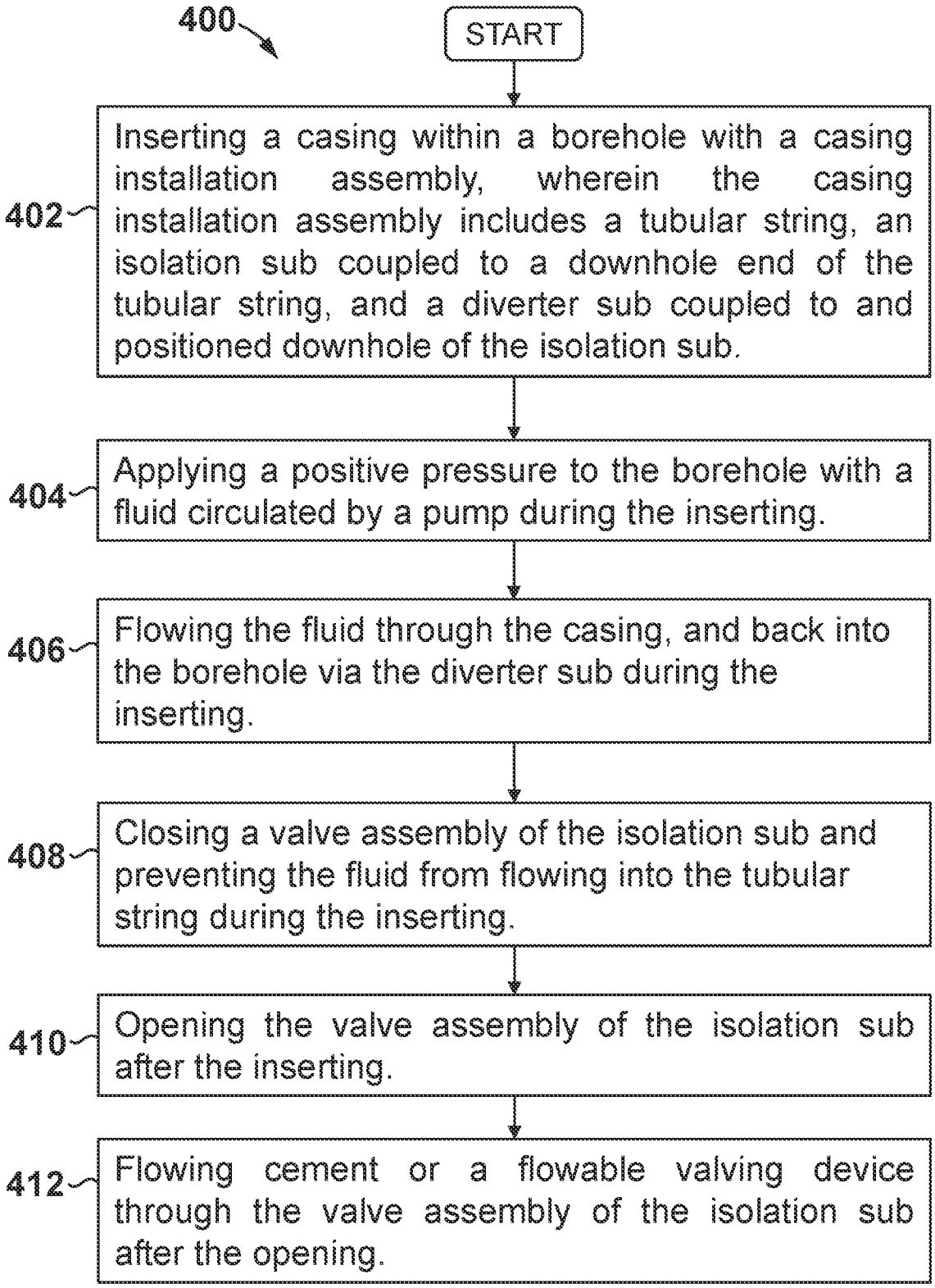
FIG. 8 is a diagram of a method for inserting a casing within a subterranean borehole according to some embodiments.

Referring now to FIG. 8, a method 400 of installing a casing within a subterranean borehole is shown. In some embodiments, method 400 may be practiced with system 10 of FIG. 1. Thus, in describing the features of method 400, reference will be made to the features of system 10, including the casing installation assembly 100 and components thereof shown in in FIGS. 1-7 and described above. However, it should be appreciated that method 400 may be practiced with different systems or devices in some embodiments, and the reference to the system 10 or components thereof is merely meant to illustrate some example embodiments of method 400.

Initially, method 400 begins, at block 402, by inserting a casing within a borehole with a casing installation assembly, wherein the casing installation assembly includes a tubular string, an isolation sub coupled to a downhole end of the tubular string, and a diverter sub coupled to and positioned downhole of the isolation sub. For instance, for the system 10 shown in FIG. 1, a casing 150 may be inserted within a borehole 8 via a casing installation assembly 100, wherein the casing installation assembly 100 includes a tubular string 22, an isolation sub 110 (or alternative isolation sub 210, or isolation sub 310 in FIGS. 4-7) coupled to a downhole end 22*b* of tubular string 22, and a diverter sub 130 coupled to the isolation sub 130. As previously described above, the diverter sub 130 may be positioned downhole of the isolation sub 110.

Referring again to FIG. 8, method 400 also includes, at block 404, applying a positive pressure to the borehole with a fluid circulated by a pump during the inserting (e.g., the inserting at block 402). For instance, as previously described above for system 10 and generally shown in FIGS. 1 and 2, a pump 14 may circulate a fluid 160 within borehole 8 so as to maintain an elevated pressure within borehole 8 and therefore prevent an uncontrolled inflow of formation fluids (e.g., oil, gas, water, etc.) into the borehole 8.

Referring again to FIG. 8, method 400 further includes flowing the fluid through the casing and back into the borehole via the diverter sub during the inserting at block 406. As previously described above with respect to system 10 in FIGS. 1 and 2, flowing fluid 160 through the casing 150 as it is inserted within borehole 8 may prevent pressure from building below the casing 150. In some circumstances, the pressure of the trapped fluid 160 below the casing 150 may rise above the fracture pressure of the borehole 8 and thereby lead to fluid losses and damage the borehole 8 itself. As a result, flowing fluid 160 through the casing 150 as it is inserted within the borehole 8 may allow the pressures above and below the casing 150 to be equalized relatively quickly so that generally faster insertion speeds may be achieved.

However, when the pressurized fluid 160 is flowed into the casing 150, there is a risk that this elevated pressure may be communicated back to the surface via the isolation sub 110 and tubular string 22 as previously described. Thus, method 400 also includes closing a valve assembly of the isolation sub and preventing the fluid from flowing into the tubular string during the inserting at block 408. The valve assembly within the isolation sub may be closed at block 408 via any suitable method. For instance, in some embodiments, the valve may comprise a flapper valve assembly (e.g., such as the valve member 222 for the isolation sub 210 shown in FIGS. 4 and 5) that may automatically close as a result of a higher pressure downhole of the valve assembly relative to a pressure uphole of the valve assembly (e.g., such as the higher pressure provided by the fluid 160 circulated by pump 14 within borehole 8 as previously described above). In some embodiments, the valve assembly may be initially placed in a closed position when inserting the casing 150 within the borehole (e.g., such as the case for the spherical valve member 322 of valve assembly 320). In some embodiments, the valve assembly (e.g., valve assembly 120) may be closed at block 408 via any suitable actuation member or assembly, such as, for instance, a hydraulic, pneumatic, electric, etc. actuation assembly.

Next, method 400 includes opening the valve assembly of the isolation sub after the inserting at block 410, and flowing cement or a flowable valving device through the valve of the isolation sub after the opening at block 412. For instance, as was described above for the system 10 of FIG. 1, after the casing 105 is inserted to the desired depth within borehole 8, cement 162 and/or flowable valving devices such as balls, darts, etc. may be flowed through the tubular string 22 toward casing 150 so as to place the cement 162 within the annular region between the casing 150 and borehole wall 6. As a result, the valve assembly 120 within isolation sub 110 is opened so as to allow the cement 162 and/or flowable valving device to advance through the isolation sub 110, diverter sub 130 and into casing 150. The valve assembly 120 within the isolation sub 110 may be opened via any suitable manner. For instance, the valve assembly 120 may generally open in response to increasing the pressure within the tubular string 22, uphole of the valve assembly 120 relative to the pressure downhole of the valve assembly 120 (e.g., such as is described above for valve assemblies 220, 320 of FIGS. 4-7). In some embodiments, the valve assembly 120 of the isolation sub 110 may be opened via a suitable actuation assembly as previously described above (e.g., hydraulic, pneumatic, electric, etc.).

Embodiments disclosed herein include systems and methods for inserting and securing a casing within a subterranean borehole while utilizing a MPD system or other suitable system for actively applying a positive pressure to the borehole. As described above, in some embodiments, the systems and methods disclosed herein may provide a downhole isolation sub (e.g., isolation subs 110, 210, 310, etc.) with a closable valve assembly (e.g., valve assemblies 120, 220, 320, etc.) therein for selectively preventing or allowing fluid communication between the borehole and the surface so as to facilitate both casing insertion and subsequent cementing operations. Therefore, through use of the systems and methods disclosed herein, casing insertion operations may be improved and simplified.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for installing a casing within a borehole, the system comprising:
- a wellhead assembly disposed at an upper end of the borehole and fluidly coupled to the borehole;
- a pump fluidly coupled to the wellhead assembly; and
- a casing installation assembly configured to be inserted through the wellhead assembly and into the borehole, wherein the casing installation assembly comprises:
  - a tubular string;
  - an isolation sub coupled to a downhole end of the tubular string;
  - a diverter sub coupled to and positioned downhole of the isolation sub; and
  - a landing string coupled to the diverter sub and configured to be coupled to the casing,
  - wherein the isolation sub comprises a valve assembly that is configured to selectively prevent fluid communication between the tubular string and the diverter sub, wherein the valve assembly has an open position configured to permit fluid communication between the tubular string and the diverter sub and a closed position configured to prevent fluid communication between the tubular string and the diverter sub;
- wherein the pump is configured to circulate a fluid from the pump through an inlet in fluid communication with the wellhead assembly and circulate the fluid from an outlet in fluid communication with the wellhead assembly to the pump with the valve assembly in the closed position to manage a pressure in the wellhead assembly and the upper end of the borehole.

2. The system of claim 1, wherein the valve assembly of the casing installation assembly is configured to open when a pressure uphole of the valve assembly is greater than a pressure downhole of valve assembly.

3. The system of claim 2, wherein the valve assembly of the casing installation assembly is configured to close when a pressure downhole of the valve assembly is greater than a pressure uphole of the valve assembly.

4. The system of claim 1, wherein the valve assembly of the casing installation assembly comprises a flapper valve assembly.

5. The system of claim 1, wherein the valve assembly of the casing installation assembly comprises a ball valve assembly.

6. The system of claim 1, wherein the diverter sub of the casing installation assembly includes a flow bore in fluid communication with the isolation sub and the landing string, and a bypass flow path that extends from the flow bore to an environment surrounding the diverter sub.

7. The system of claim 1, comprising:
- a drilling rig; and
- a riser extending between the drilling rig and the wellhead assembly;
- wherein the casing installation assembly is configured to be inserted through the riser.

8. A method of installing a casing within a borehole, the method comprising:

(a) inserting a casing within the borehole with a casing installation assembly, wherein the casing installation assembly comprises:

a tubular string;

an isolation sub coupled to a downhole end of the tubular string; and a diverter sub coupled to and downhole of the isolation sub;

(b) closing a valve assembly of the isolation sub and preventing the fluid from flowing into the tubular string during (a);

(c) circulating a fluid with a pump through an inlet in fluid communication with an upper end of the borehole to apply a positive pressure to the borehole during (a) and after (b);

(d) flowing the fluid through the casing and back into the borehole via the diverter sub during (a); and (e) circulating the fluid from an outlet in fluid communication with the upper end of the borehole during (c).

9. The method of claim 8, comprising:

(f) opening the valve assembly of the isolation sub after (a); and (g) flowing cement or a flowable valving device through the valve assembly of the isolation sub after (f).

10. The method of claim 9, wherein (f) comprises:

(f1) increasing a pressure uphole of the valve assembly relative to a pressure downhole of the valve assembly; and (f2) opening the valve assembly as a result of (f1).

11. The method of claim 10, wherein (b) comprises:

(b1) increasing the pressure downhole of the valve assembly relative to the pressure uphole of the valve assembly; and (b2) closing the valve assembly as a result of (b1).

12. The method of claim 8, wherein (b) comprises closing a flapper valve assembly within the isolation sub.

13. The method of claim 8, wherein (b) comprises closing a ball valve assembly within the isolation sub.

* * * * *